US011939738B2

(12) United States Patent
Stroyer

(10) Patent No.: US 11,939,738 B2
(45) Date of Patent: Mar. 26, 2024

(54) PILE FOUNDATION BRACKET

(71) Applicant: Benjamin G. Stroyer, East Rochester, NY (US)

(72) Inventor: Benjamin G. Stroyer, East Rochester, NY (US)

( * ) Notice: Subject to any disclaimer, the term of this patent is extended or adjusted under 35 U.S.C. 154(b) by 15 days.

(21) Appl. No.: 17/708,224

(22) Filed: Mar. 30, 2022

(65) Prior Publication Data

US 2022/0333329 A1 Oct. 20, 2022

Related U.S. Application Data

(60) Provisional application No. 63/168,345, filed on Mar. 31, 2021.

(51) Int. Cl.

| | |
|---|---|
| ***E02D 5/00*** | (2006.01) |
| ***E02D 7/16*** | (2006.01) |
| ***E02D 27/12*** | (2006.01) |
| *E02D 5/22* | (2006.01) |
| *E02D 27/48* | (2006.01) |
| *E02D 35/00* | (2006.01) |

(52) U.S. Cl.

CPC ..... *E02D 7/16* (2013.01); *E02D 5/00* (2013.01); *E02D 27/12* (2013.01); *E02D 5/22* (2013.01); *E02D 27/48* (2013.01); *E02D 35/00* (2013.01)

(58) Field of Classification Search

CPC .... E02D 5/00; E02D 5/38; E02D 5/56; E02D 5/62; E02D 5/72; E02D 7/12; E02D 7/22; E02D 27/48; E02D 33/00; E02D 35/00; E02D 5/22; E02D 27/12

USPC ..... 405/230, 232, 249, 252.1, 296, 253; 173/1, 190, 90

See application file for complete search history.

(56) References Cited

U.S. PATENT DOCUMENTS

| | | | | |
|---|---|---|---|---|
| 4,673,315 | A * | 6/1987 | Shaw | E02D 35/00 405/230 |
| 5,176,472 | A | 1/1993 | Kinder | |
| 6,079,905 | A * | 6/2000 | Ruiz | E02D 27/48 405/230 |
| 6,142,710 | A * | 11/2000 | Holland, Jr | E04G 23/065 405/230 |

(Continued)

OTHER PUBLICATIONS

International Search Report and Written Opinion for PCT/US2022/022464 Jun. 29, 2022.

*Primary Examiner* — Scott A Smith

(74) *Attorney, Agent, or Firm* — Michael J. Nickerson; Dawson Law Firm, PC

(57) ABSTRACT

A pile driver driven foundation bracket system includes a foundation bracket drive unit and a foundation bracket unit. The foundation bracket drive unit includes a pile driving unit interface configured to engage with a pile driving unit, a hollow sleeve, and a foundation bracket drive interface. The pile driving unit interface is connected to a first end of the hollow sleeve, and the foundation bracket drive interface is connected to a second end of the hollow sleeve. The foundation bracket drive interface is removably connected to the foundation bracket unit. The foundation bracket unit includes a horizontal foundation bracket support arm, a foundation bracket brace having an opening, the opening being configured to allow soil to flow therethrough when the foundation bracket unit is rotated, and a foundation bracket hollow sleeve.

16 Claims, 8 Drawing Sheets

(56) References Cited

U.S. PATENT DOCUMENTS

| | | | | |
|---|---|---|---|---|
| 6,514,012 | B2 * | 2/2003 | Gregory | E02D 35/00 405/230 |
| 6,539,685 | B2 * | 4/2003 | Bell | E02D 35/00 405/230 |
| 7,097,388 | B1 * | 8/2006 | Mansour | E02D 35/00 405/230 |
| 7,435,038 | B2 * | 10/2008 | Peterson | E02D 27/48 52/126.5 |
| 8,402,837 | B1 * | 3/2013 | Jones | E02D 33/00 73/788 |
| 2004/0071511 | A1 | 4/2004 | May | |
| 2006/0216117 | A1 | 9/2006 | Peterson | |
| 2008/0152434 | A1 | 6/2008 | Bracken et al. | |
| 2008/0170912 | A1 * | 7/2008 | Kaufman | E02D 35/005 405/232 |
| 2014/0259989 | A1 | 9/2014 | Gregory et al. | |
| 2018/0371716 | A1 | 12/2018 | Gantt | |

* cited by examiner

PILE FOUNDATION BRACKET

PRIORITY INFORMATION

The present application claims priority, under 35 U.S.C. § 119(e), from U.S. Provisional Patent Application, Ser. No. 63/168,345, filed on Mar. 31, 2021. The entire content of U.S. Provisional Patent Application, Ser. No. 63/168,345, filed on Mar. 31, 2021, is hereby incorporated by reference.

BACKGROUND

Conventionally, to shore up or add support to a sinking foundation, piles have been driven into the soil near the foundation and brackets, connected to the piles have been placed under the foundation's footing to provide the needed support.

As illustrated in FIG. 1, to prepare for the shoring up process, a hole 40 is dug in the soil 50 that surrounds the foundation 10 and footing 20. In addition, an area 30 under the footing 20 is dug (typically eight to twelve inches under the footing 20) by hand to enable the placement of the bracket (not shown). The footing is notched (not shown) to allow a pile 60 to be driven into the soil 50 near the foundation 10. The pile 60 can be driven to a depth to engage bedrock or other medium that will provide appropriate support for the foundation.

As illustrated in FIG. 2, once the pile 60 is driven into the soil 50 to the appropriate depth (to engage bedrock or other medium that will provide appropriate support for the foundation), the excess length of pile may be cut off so that the pile 60 ends at an appropriate height above the top of the footing 20. After the pile 60 is cut to the appropriate length, a bracket consisting of an outer sleeve 72, a support arm 74, and a solid brace 76 are slid over the pile 60 such that the support arm 74 and the solid brace 76 are away from the footing 20.

As illustrated in FIG. 3, the support arm 74 and the solid brace 76 are hand rotated (clockwise or counter-clockwise) such that the support arm 74 and the solid brace 76 enter the area 30 under the footing 20, enabling the support arm 74 to engage the bottom of the footing 20.

As described above, the conventional process requires excavation of an area under the footing to enable the placement of the bracket under the footing. This excavation is done by hand and very laborious.

Moreover, the conventional process requires the manual rotation of the bracket to enable the bracket to engage the bottom of the footing.

Therefore, it is desirable to provide a pile foundation bracket that can be placed under the footing without requiring the excavation of an area under the footing.

Also, it is desirable to provide a pile foundation bracket that can be placed under the footing, using the torque of the pile driver.

Furthermore, it is desirable to provide a pile foundation bracket that can be placed under the footing, using the torque of the pile driver, without requiring the excavation of an area under the footing.

BRIEF DESCRIPTION OF THE DRAWINGS

The drawings are only for purposes of illustrating various embodiments and are not to be construed as limiting, wherein.

DETAILED DESCRIPTION

Figure 1:
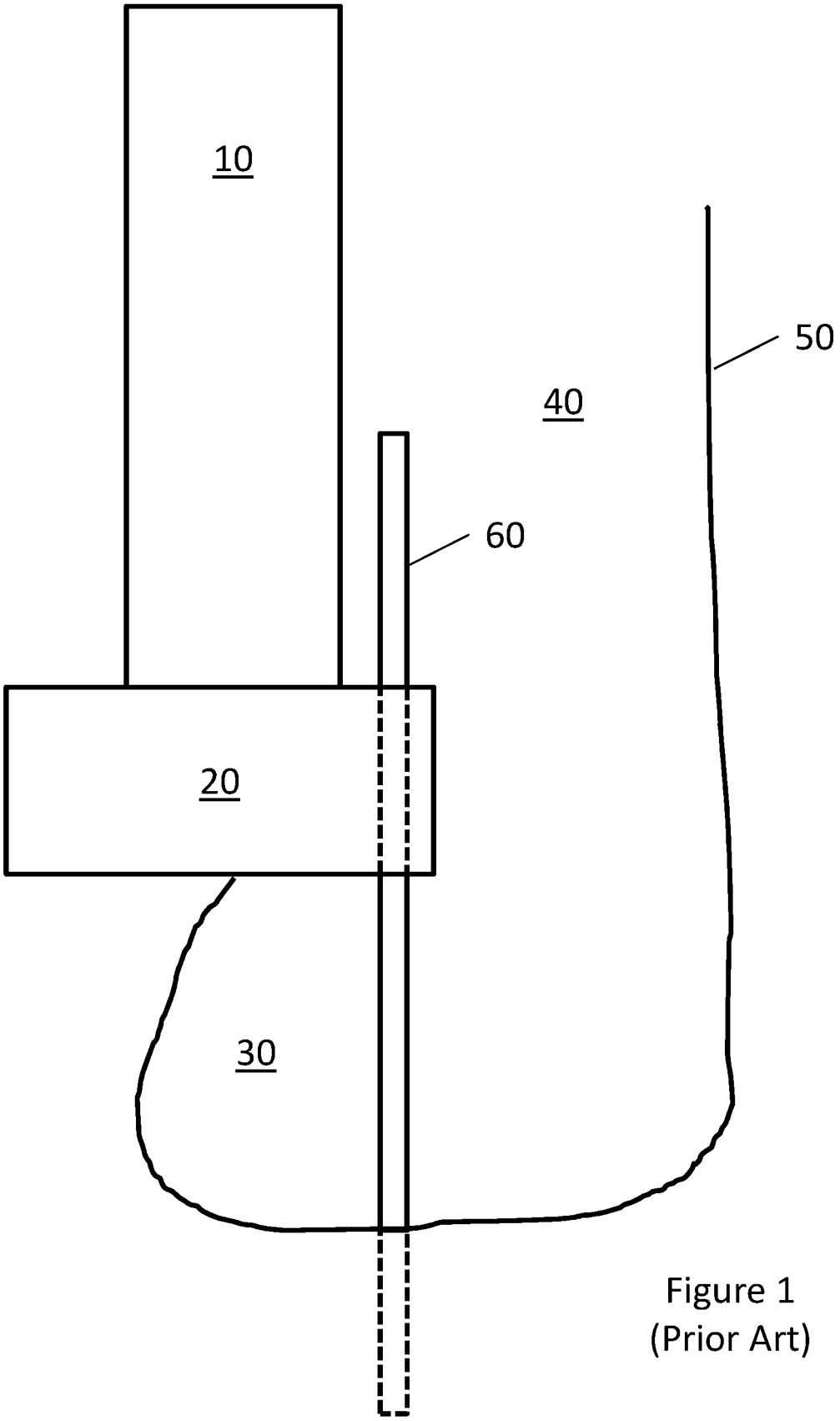
Figure 1 (Prior Art)
FIG. 1 illustrates a pile positioned for supporting a foundation.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 4:
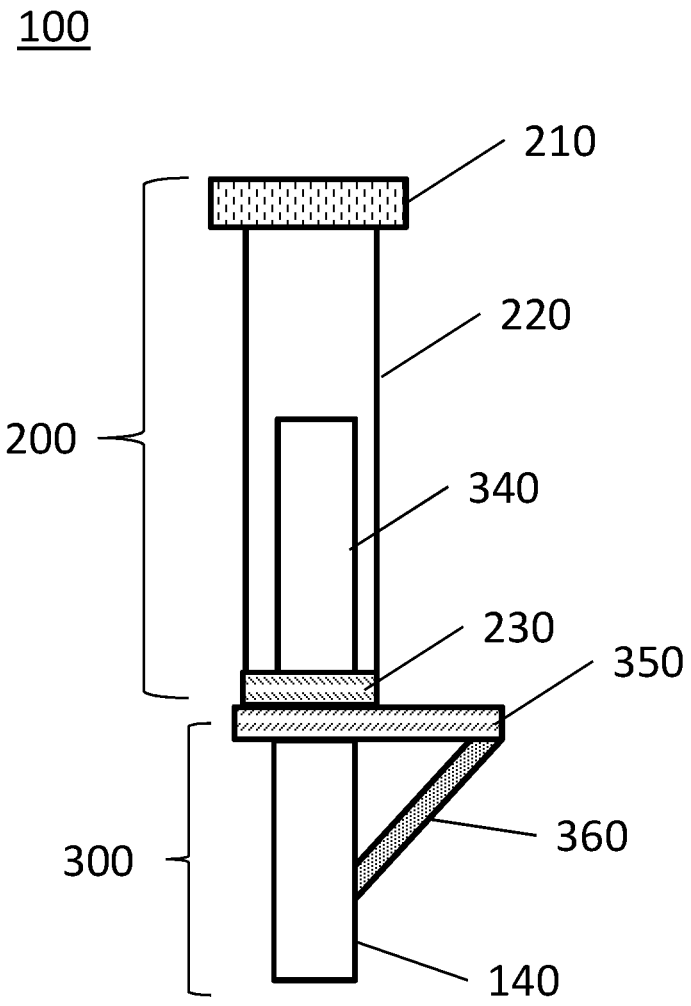
FIG. 4 illustrates a pile foundation bracket device that interfaces with a pile driving unit.

FIG. 4 illustrates a pile driver driven foundation bracket system 100 that interfaces with a pile driving unit (not shown). The pile driver driven foundation bracket system 100 includes a foundation bracket drive unit 200 and a foundation bracket unit 300. The foundation bracket drive unit 200 includes a pile driving unit interface 210 that engages with a pile driving unit (not shown) to enable the foundation bracket drive unit 200 to be rotated and to be moved horizontally and/or vertically.

The pile driving unit interface 210 is connected to a first end of a hollow sleeve 220. At a second end of the hollow sleeve 220, a foundation bracket drive interface 230 is connected. The pile driving unit interface 210 may be connected to the first end of a hollow sleeve 220, using bolts, rivets, pins, a weld, etc. The foundation bracket drive interface 230 may be connected to the second end of a hollow sleeve 220, using bolts, rivets, pins, a weld, etc.

The foundation bracket drive interface 230 is removably connectable to the foundation bracket unit 300. This connection enables the foundation bracket unit 300 to be rotated and to be moved horizontally and/or vertically with the foundation bracket drive unit 200.

The foundation bracket unit 300 has a horizontal foundation bracket support arm 350, a foundation bracket brace 360, and a foundation bracket hollow sleeve 340. The foundation bracket drive interface 230 is also configured to allow a portion of the pile foundation bracket hollow sleeve 340 to pass therethrough.

As illustrated in FIG. 4, the foundation bracket brace 360 is open to allow the soil to flow therethrough when the foundation bracket unit 300 is rotated. Moreover, the surface of the foundation bracket brace 360 may be curved or has a C-shape (arc), such that a center point line of the curve or C-shape (arc) intersects the horizontal foundation bracket support arm 350 and the foundation bracket hollow sleeve 340, to enable the foundation bracket brace 360 to cut through the soil when the foundation bracket unit 300 is rotated. It is noted that the curvature of the foundation bracket brace 360 may follow the curvature of the foundation bracket hollow sleeve 340.

Figure 5:
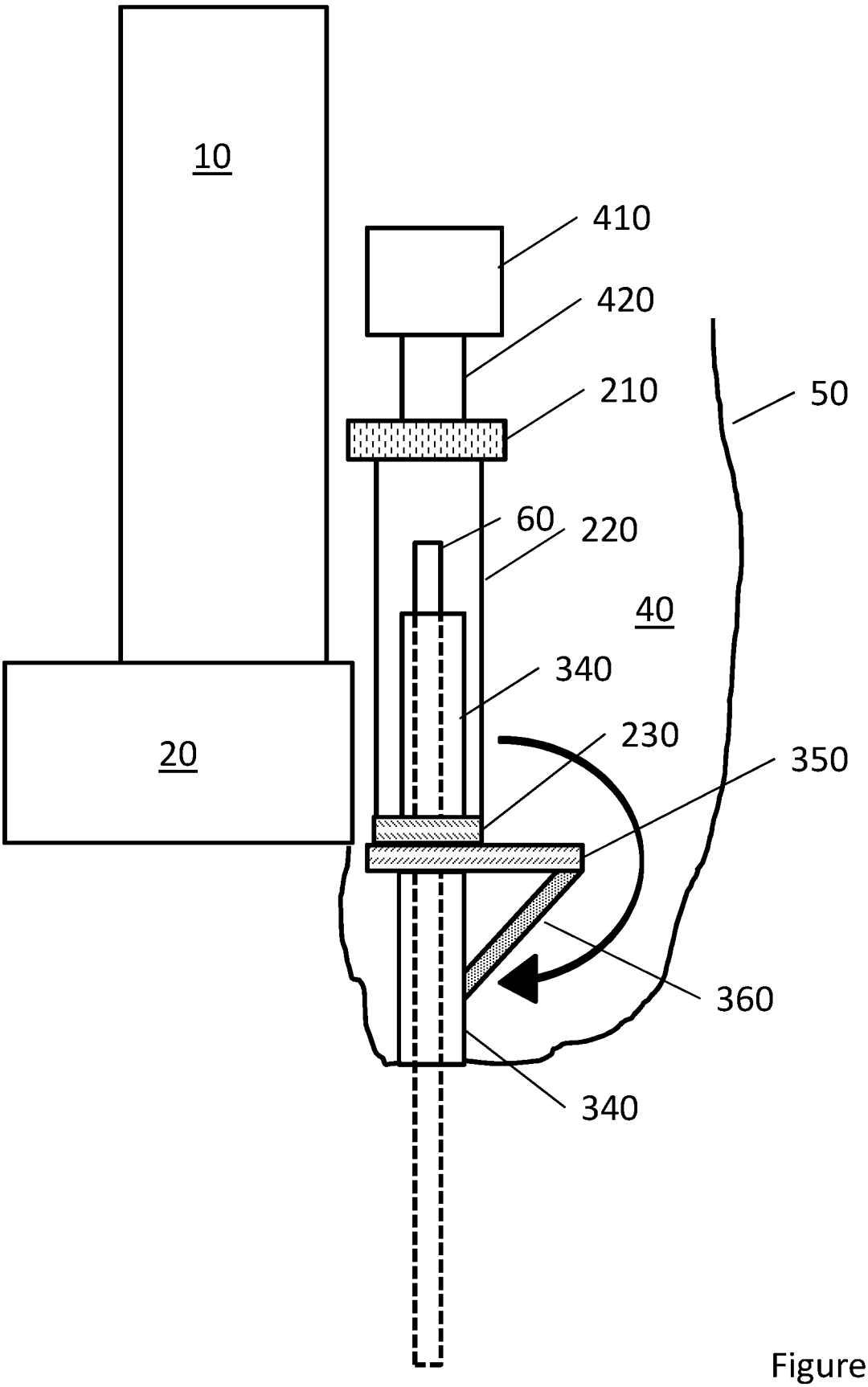
FIG. 5 illustrates pre-staging of the pile foundation bracket device of FIG. 4 connected to a pile driving unit.

FIG. 5 illustrates pre-staging of the pile foundation bracket system of FIG. 4 connected to a pile driving unit. As illustrated in FIG. 5, a pile foundation bracket system is connected, via a pile driving unit interface 210, to a pile driving unit interface 420, which is connected to a pile driving unit 410. The pile driving unit interface 210 engages with a pile driving unit interface 420 to enable the pile foundation bracket system to be rotated and to be moved horizontally and/or vertically.

The pile driving unit interface 210 is connected to a first end of a hollow sleeve 220. At a second end of the hollow sleeve 220, a foundation bracket drive interface 230 is connected. The pile driving unit interface 210 may be connected to the first end of a hollow sleeve 220, using bolts, rivets, pins, a weld, etc. The foundation bracket drive interface 230 may be connected to the second end of a hollow sleeve 220, using bolts, rivets, pins, a weld, etc.

The foundation bracket drive interface 230 is removably connectable to a foundation bracket unit having a horizontal foundation bracket support arm 350, a foundation bracket brace 360, and a foundation bracket hollow sleeve 340.

The foundation bracket drive interface 230 is also configured to allow a portion of the pile foundation bracket hollow sleeve 340 to pass therethrough. The pile foundation bracket hollow sleeve 340 is configured to allow a pile 60 to pass therethrough.

The foundation bracket drive interface 230 is removably connected to the foundation bracket unit so that the rotation forces and the vertical forces from a pile driving unit 410 are transferred to the foundation bracket unit.

As illustrated in FIG. 5, the foundation bracket brace 360 is open to allow the soil to flow therethrough when the foundation bracket unit is rotated. Moreover, the surface of the foundation bracket brace 360 may be curved or has a C-shape (arc), such that a center point line of the curve or C-shape (arc) intersects the horizontal foundation bracket support arm 350 and the foundation bracket hollow sleeve 340, to enable the foundation bracket brace 360 to cut through the soil when the foundation bracket unit is rotated. It is noted that the curvature of the foundation bracket brace 360 may follow the curvature of the foundation bracket hollow sleeve 340.

Figure 2:
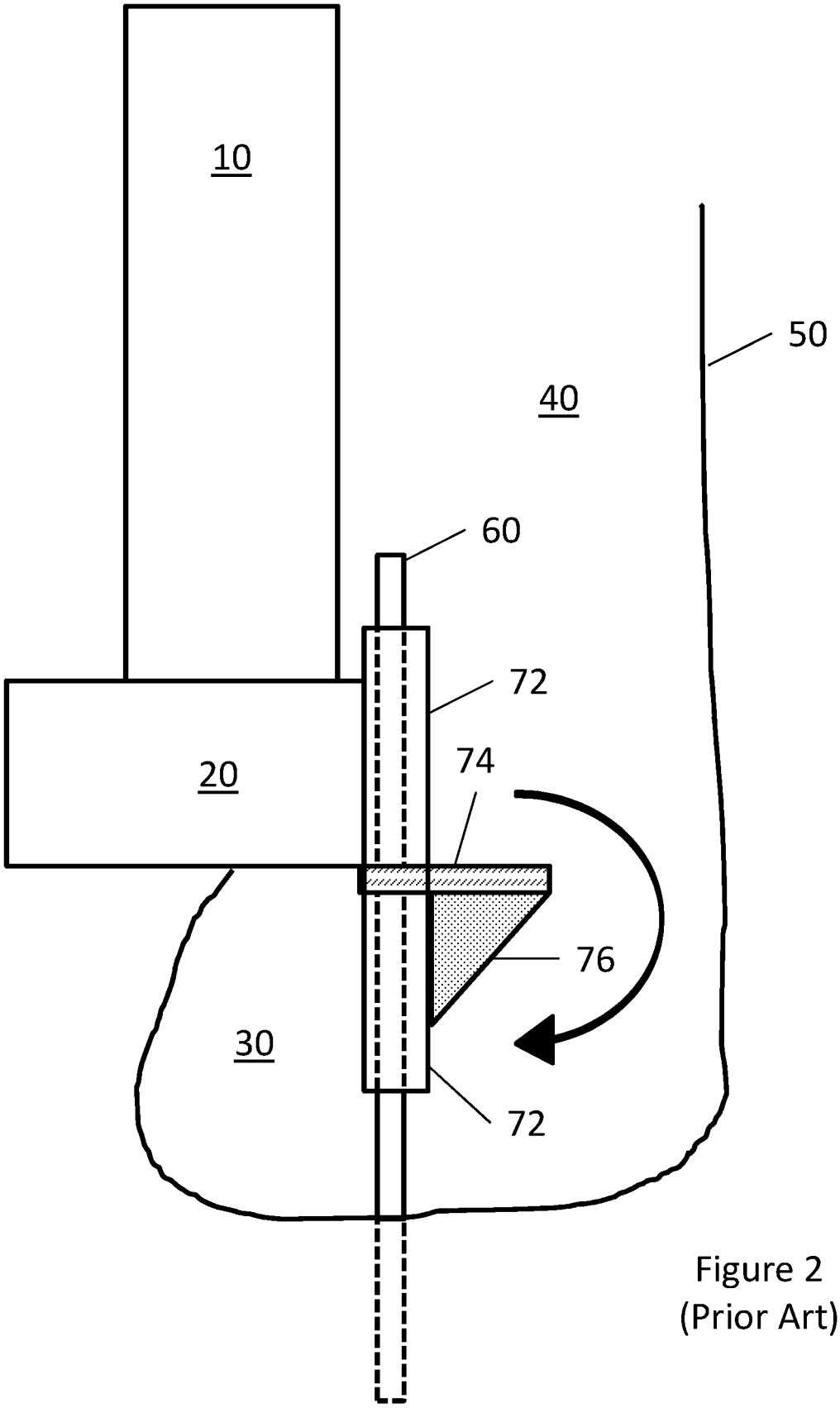
Figure 2 (Prior Art)
FIG. 2 illustrates pre-staging of a conventional pile foundation bracket and pile for supporting a foundation.

Furthermore, as illustrated in FIG. 5, the configuration of the foundation bracket unit, namely, the open structure and curved shaped, allows the foundation bracket unit to be installed under the footing 20 of the foundation 10, without excavating underneath the footing 20, as required with the conventional foundation bracket of FIGS. 1 and 2.

In other words, the only pre-installation excavation that is needed is the excavation of hole 40, alongside the foundation 10 and footing 20, in the soil 50.

As shown in FIG. 5, during pre-staging, the horizontal foundation bracket support arm 350 projects away from the footing 20. When it positioned appropriately in a vertical direction, the horizontal foundation bracket support arm 350 is rotated, clockwise or counterclockwise, by the pile driving unit 410 so that the horizontal foundation bracket support arm 350 is positioned under the footing 20, as illustrated in FIG. 6, to engage the footing 20.

As noted above, if the horizontal foundation bracket support arm 350 needs to be moved in a vertical direction, the pile driving unit 410 can provide the necessary forces to achieve the required or desired vertical movement.

Figure 6:
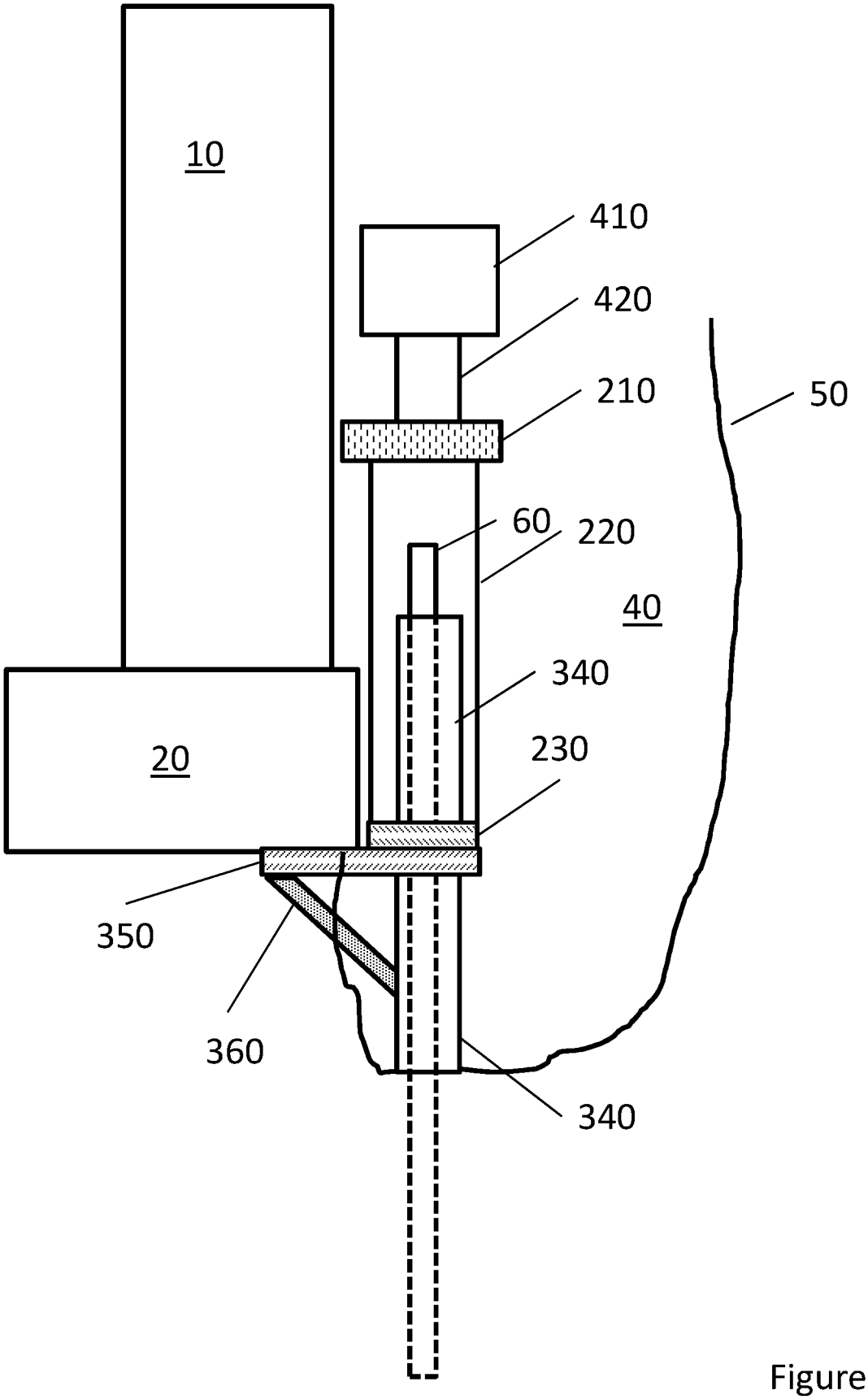
FIG. 6 illustrates the pile foundation bracket device of FIG. 4 connected to the pile driving unit and engaged with the foundation.

As illustrated in FIG. 6, when the horizontal foundation bracket support arm 350 is rotated to bring the horizontal foundation bracket support arm 350 into engagement with the footing 20, the foundation bracket brace 360 cuts through the soil so that pre-excavation under the footing 20 is not required.

The elimination of the pre-excavation under the footing reduces the need of manual labor when installing a foundation bracket, as well as, reducing the time needed for installation of the foundation bracket.

Moreover, the utilization of the pile driving unit to position the foundation bracket under the footing reduces the need of manual labor when installing a foundation bracket, as well as, reducing the time needed for installation of the foundation bracket.

Figure 3:
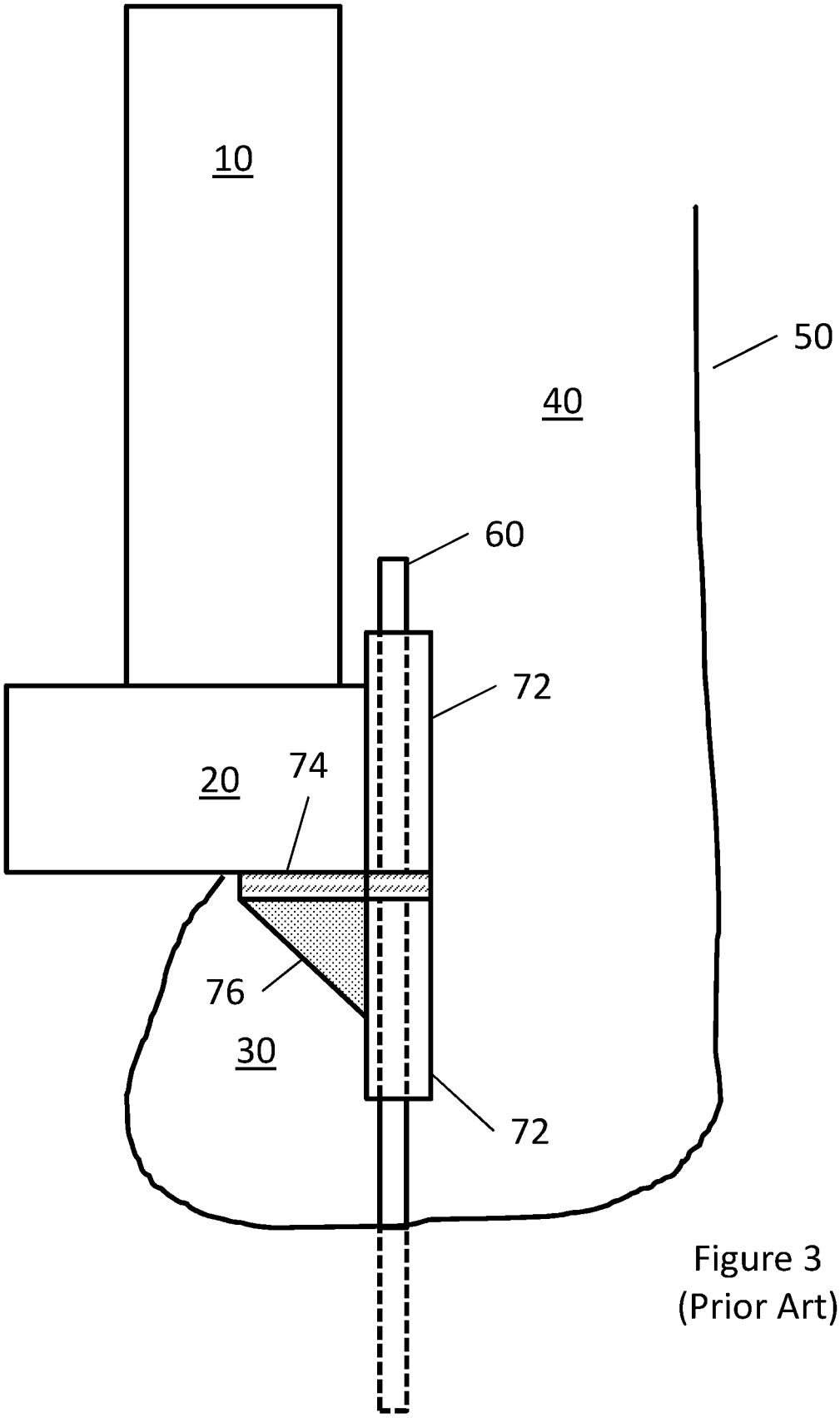
Figure 3 (Prior Art)
FIG. 3 illustrates the conventional pile foundation bracket and pile of FIG. 2 engaged with a foundation.
Figure 7:
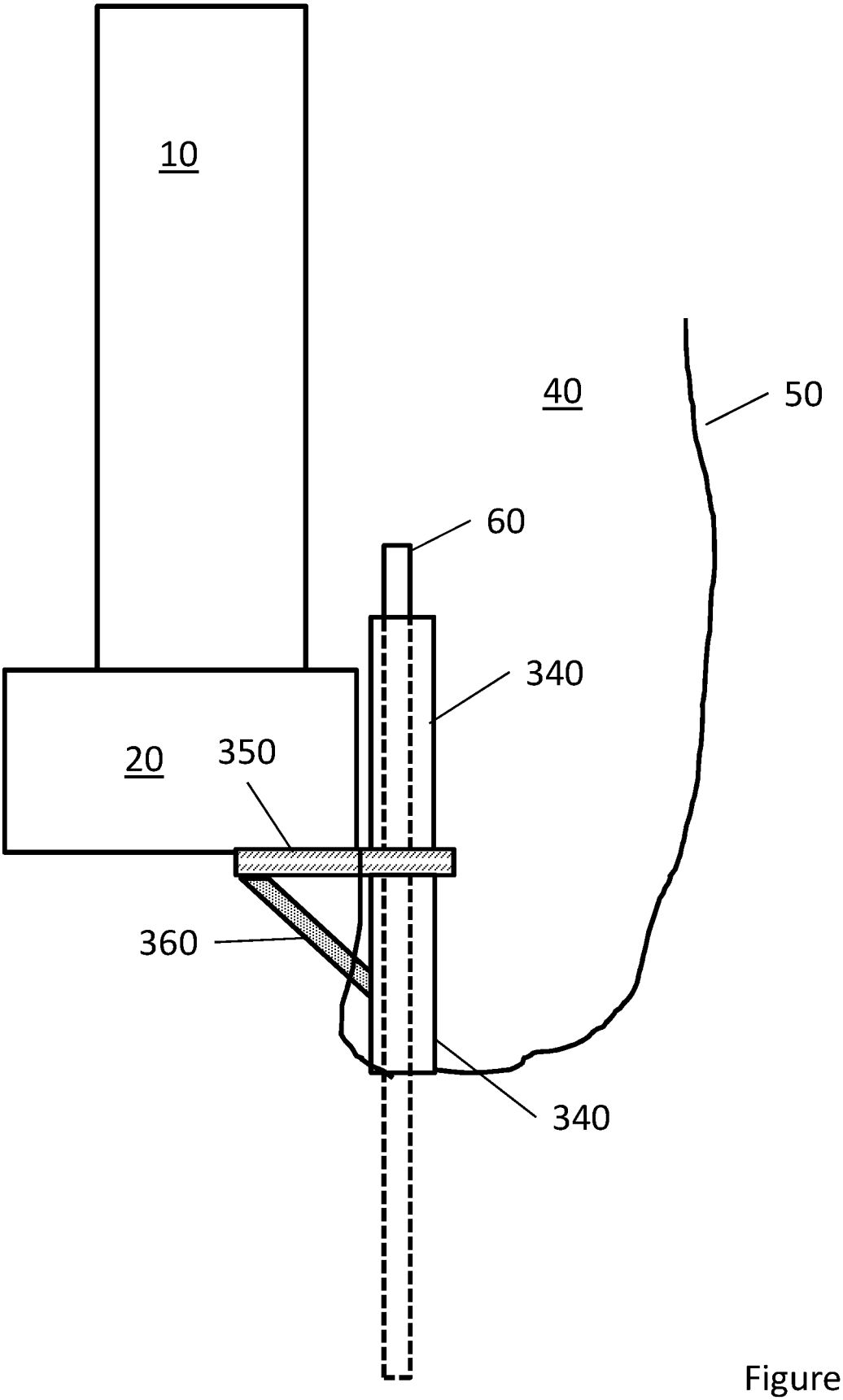
FIG. 7 illustrates the pile foundation bracket of FIG. 4 without the connected to the pile driving unit and engaged with the foundation.

FIG. 7 illustrates the foundation bracket unit of FIG. 4, without being connected to the foundation bracket drive unit and the pile driving unit, engaged with the foundation. As illustrated in FIG. 7, once the horizontal foundation bracket support arm 350 properly engages with the footing 20, the pile driver driven foundation bracket system can be disassembled by disconnecting the foundation bracket drive interface (230 of FIG. 3) from the foundation bracket unit. This disassembly leaves only the horizontal foundation bracket support arm 350, the foundation bracket brace 360, the foundation bracket hollow sleeve 340, and the pile 60 to support the foundation 10 and the footing 20.

The foundation bracket unit may be connected to the plie 60 using bolts, rivets, welding, etc. The connection should be strong enough to support the foundation through the combination of the foundation bracket unit and the plie 60 so that the foundation bracket unit does not slide down the pile 60, defeating the purpose of the foundation bracket unit.

Figure 8:
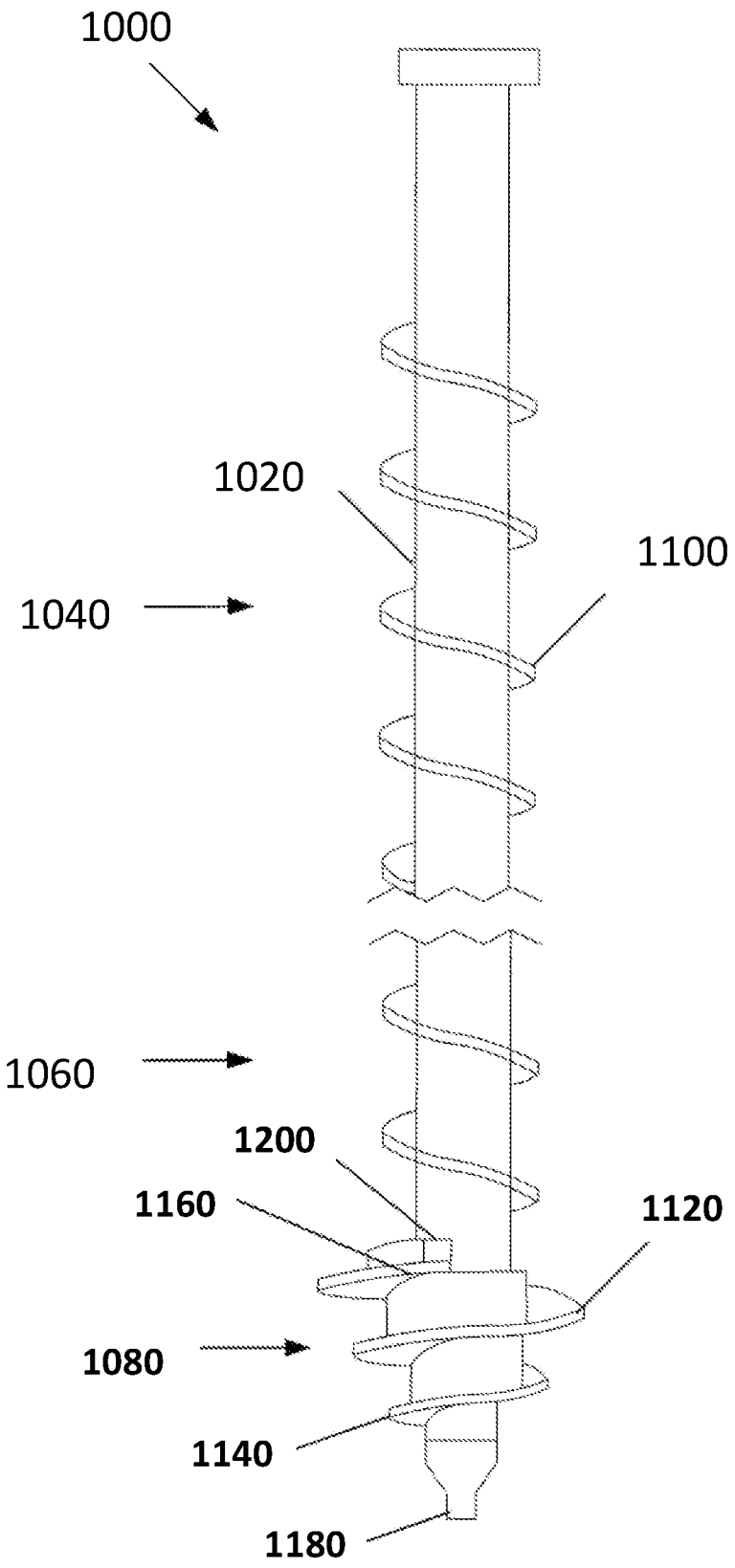
FIG. 8 illustrates an example of a pile.

FIG. 8 illustrates an example of a pile. As illustrated in FIG. 8, an auger grouted displacement pile 1000 includes an elongated, tubular pipe 1020 with a hollow central chamber, a top section 1040 and a bottom section 1060. Bottom section 1060 includes a soil (medium) displacement head 1080. Top section 1040 includes a reverse auger 1100. Soil (medium) displacement head 1080 has a cutting blade 1120 that has a leading edge 1140 and a trailing edge 1160.

The leading edge 1140 of cutting blade 1120 cuts into the soil (medium) as the pile is rotated and loosens the soil (medium) at such contact point. The soil (medium) displacement head 1080 may be equipped with a point 1180 to promote this cutting.

The loosened soil (medium) passes over cutting blade 1120 and thereafter past trailing edge 1160. The uppermost portion of cutting blade 1120 includes a deformation structure 1200 that displaces the soil (medium) as the cutting blade 1120 cuts into the soil (medium) to create an annulus.

The leading edge 1140 of cutting blade 1120 cuts into the soil (medium) as the deformed displacement pile 1000 is rotated and loosens the soil (medium) at such contact point. The soil (medium) displacement head 1080 may be equipped with a point 1180 to promote this cutting.

The loosened soil (medium) passes over cutting blade 1120 and thereafter past trailing edge 1160. As the loosened soil medium passes over cutting blade 1120 and thereafter past trailing edge 1160, the soil (medium) is laterally compacted by lateral compaction elements. The lateral compaction elements create an annulus having outer wall and void.

The uppermost portion of cutting blade 1120 may include a deformation structure 1200 that displaces the soil (medium) as the cutting blade 1120 cuts into the outer wall of the annulus to create a spiral groove in the outer wall of the annulus.

After the displacement pile 1000 is driven into position, grout (not shown) is introduced into the void of the annulus. The grout can be introduced by means of gravity or pressure into the void of the annulus.

Additionally, since the displacement pile 1000 is a hollow tube, the grout can be introduced into the void of the annulus through the hollow tube by means of gravity or pressure, wherein the displacement pile 1000 would include openings (not shown) that allows the grout to leave the pile and enter into the void of the annulus.

Other examples of displacement piles are disclosed in Published US Patent Application Number 2020/0190762, Published US Patent Application Number 2022/00042267, and co-pending U.S. patent application Ser. No. 17/528,642. The entire contents of Published US Patent Application Number 2020/0190762 and Published US Patent Application Number 2022/00042267 are hereby incorporated by reference. The entire content of U.S. patent application Ser. No. 17/528,642 is hereby incorporated by reference.

A pile driver driven foundation bracket system, comprises a foundation bracket drive unit and a foundation bracket unit; the foundation bracket drive unit including a pile driving unit interface configured to engage with a pile driving unit to enable the foundation bracket drive unit to be rotated and moved horizontally or vertically, a hollow sleeve, and a foundation bracket drive interface; the pile driving unit interface being connected to a first end of the hollow sleeve; the foundation bracket drive interface being connected to a second end of the hollow sleeve; the foundation bracket drive interface being removably connected to the foundation bracket unit; the foundation bracket unit including a horizontal foundation bracket support arm, a foundation bracket brace having an opening, the opening being configured to allow soil to flow therethrough when the foundation bracket unit is rotated, and a foundation bracket hollow sleeve.

A surface of the foundation bracket brace may be curved.

A center point line of the curved surface of the foundation bracket brace may intersect the horizontal foundation bracket support arm and the foundation bracket hollow sleeve.

The curved surface of the foundation bracket brace may be configured to enable the foundation bracket brace to cut through soil when the foundation bracket unit is rotated.

The curved surface of the foundation bracket brace may follow a curvature of the foundation bracket hollow sleeve.

A surface of the foundation bracket brace may be C-shaped.

A center point line of the C-shaped surface of the foundation bracket brace may intersect the horizontal foundation bracket support arm and the foundation bracket hollow sleeve.

The C-shaped surface of the foundation bracket brace may be configured to enable the foundation bracket brace to cut through soil when the foundation bracket unit is rotated.

The C-shaped surface of the foundation bracket brace may follow a curvature of the foundation bracket hollow sleeve.

A foundation bracket unit comprises a horizontal foundation bracket support arm; a foundation bracket brace having an opening, the opening being configured to allow soil to flow therethrough when the foundation bracket unit is rotated; and a foundation bracket hollow sleeve.

A surface of the foundation bracket brace may be curved.

A center point line of the curved surface of the foundation bracket brace may intersect the horizontal foundation bracket support arm and the foundation bracket hollow sleeve.

The curved surface of the foundation bracket brace may be configured to enable the foundation bracket brace to cut through soil when the foundation bracket unit is rotated.

The curved surface of the foundation bracket brace may follow a curvature of the foundation bracket hollow sleeve.

A surface of the foundation bracket brace may be C-shaped.

A center point line of the C-shaped surface of the foundation bracket brace may intersect the horizontal foundation bracket support arm and the foundation bracket hollow sleeve.

The C-shaped surface of the foundation bracket brace may be configured to enable the foundation bracket brace to cut through soil when the foundation bracket unit is rotated.

The C-shaped surface of the foundation bracket brace may follow a curvature of the foundation bracket hollow sleeve.

A method of installing a foundation brace under a foundation to provide support thereof, comprises (a) excavating a hole near a foundation; (b) driving a pile into the excavated hole; (c) cutting the pile to a predetermined length; (d) placing a pile driver driven foundation bracket system, including a foundation bracket drive unit and a foundation bracket unit, over the pile, the foundation bracket unit including a horizontal foundation bracket support arm, a foundation bracket brace having an opening, the opening being configured to allow soil to flow therethrough when the foundation bracket unit is rotated, and a foundation bracket hollow sleeve; (e) connecting a pile driver to the pile driver driven foundation bracket system; (f) rotating the pile driver driven foundation bracket system, using the pile driver, so that the horizontal foundation bracket support arm is positioned under the foundation; (g) connecting the foundation bracket unit to the pile; (h) disconnecting the pile driver driven foundation bracket system from the pile driver; (i) disconnecting the foundation bracket drive unit from the foundation bracket unit; and (j) filing the hole.

The foundation bracket unit may be welded to the pile.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A pile driver driven foundation bracket system, comprising:

a foundation bracket drive unit; and a foundation bracket unit;

said foundation bracket drive unit including, a pile driving unit interface configured to engage with a pile driving unit to enable said foundation bracket drive unit to be rotated and moved horizontally or vertically, a hollow sleeve, and a foundation bracket drive interface;

said pile driving unit interface being connected to a first end of said hollow sleeve;

said foundation bracket drive interface being connected to a second end of said hollow sleeve;

said foundation bracket drive interface being removably connected to said foundation bracket unit;

said foundation bracket unit including, a horizontal foundation bracket support arm, a foundation bracket brace having an opening, the opening being configured to allow soil to flow therethrough when said foundation bracket unit is rotated, and a foundation bracket hollow sleeve.

2. The pile driver driven foundation bracket system, as claimed in claim 1, wherein a surface of said foundation bracket brace is curved.

3. The pile driver driven foundation bracket system, as claimed in claim 2, wherein said curved surface of said foundation bracket brace is configured to enable said foundation bracket brace to cut through soil when said foundation bracket unit is rotated.

4. The pile driver driven foundation bracket system, as claimed in claim 2, wherein said curved surface of said foundation bracket brace follows a curvature of said foundation bracket hollow sleeve.

5. The pile driver driven foundation bracket system, as claimed in claim 1, wherein a surface of said foundation bracket brace is C-shaped.

6. The pile driver driven foundation bracket system, as claimed in claim 5, wherein said C-shaped surface of said foundation bracket brace is configured to enable said foundation bracket brace to cut through soil when said foundation bracket unit is rotated.

7. The pile driver driven foundation bracket system, as claimed in claim 6, wherein said C-shaped surface of said foundation bracket brace follows a curvature of said foundation bracket hollow sleeve.

8. A foundation bracket unit comprising:

a horizontal foundation bracket support arm;

a foundation bracket brace connected to said horizontal foundation bracket support arm; and a foundation bracket hollow sleeve connected to said horizontal foundation bracket support arm and said foundation bracket brace;

said horizontal foundation bracket support arm, said foundation bracket brace, and said foundation bracket hollow sleeve being connected together to form an opening between said horizontal foundation bracket support arm, said foundation bracket brace, and said foundation bracket hollow sleeve, said opening being configured to allow soil to flow therethrough when the foundation bracket unit is rotated.

9. The foundation bracket unit, as claimed in claim 8, wherein a surface of said foundation bracket brace is curved.

10. The foundation bracket unit, as claimed in claim 9, wherein said curved surface of said foundation bracket brace is configured to enable said foundation bracket brace to cut through soil when said foundation bracket unit is rotated.

11. The foundation bracket unit, as claimed in claim 9, wherein said curved surface of said foundation bracket brace follows a curvature of said foundation bracket hollow sleeve.

12. The foundation bracket unit, as claimed in claim 8, wherein a surface of said foundation bracket brace is C-shaped.

13. The foundation bracket unit, as claimed in claim 12, wherein said C-shaped surface of said foundation bracket brace is configured to enable said foundation bracket brace to cut through soil when said foundation bracket unit is rotated.

14. The foundation bracket unit, as claimed in claim 12, wherein said C-shaped surface of said foundation bracket brace follows a curvature of said foundation bracket hollow sleeve.

15. A method of installing a foundation brace under a foundation to provide support thereof, comprising:

(a) excavating a hole near a foundation;

(b) driving a pile into the excavated hole;

(c) cutting the pile to a predetermined length;

(d) placing a pile driver driven foundation bracket system, including a foundation bracket drive unit and a foundation bracket unit, over the pile, the foundation bracket unit including a horizontal foundation bracket support arm, a foundation bracket brace having an opening, the opening being configured to allow soil to flow therethrough when the foundation bracket unit is rotated, and a foundation bracket hollow sleeve;

(e) connecting a pile driver to the pile driver driven foundation bracket system;

(f) rotating the pile driver driven foundation bracket system, using the pile driver, so that the horizontal foundation bracket support arm is positioned under the foundation;

(g) connecting the foundation bracket unit to the pile;

(h) disconnecting the pile driver driven foundation bracket system from the pile driver;

(i) disconnecting the foundation bracket drive unit from the foundation bracket unit; and (j) filing the hole.

16. The method, as claimed in claim 15, wherein the foundation bracket unit is welded to the pile.

* * * * *